United States Patent [19]

Ziemek et al.

[11] 4,342,190

[45] Aug. 3, 1982

[54] STRANDING STOCK OF LARGE CROSS SECTIONS

[75] Inventors: Gerhard Ziemek, Langenhagen; Wolfram Klebl, Isernhagen; Ernst Hoffmann, Langenhagen; Reiner Brünn, Essel, all of Fed. Rep. of Germany

[73] Assignee: Kabel-und Metallwerke Gutehoffnungshutte Aktiengesellschaft, Hanover, Fed. Rep. of Germany

[21] Appl. No.: 205,261

[22] Filed: Nov. 10, 1980

[30] Foreign Application Priority Data

Nov. 16, 1979 [DE] Fed. Rep. of Germany ..... 2946248

[51] Int. Cl.[3] ..... H01B 13/04; D07B 3/00; D07B 7/14

[52] U.S. Cl. ..... 57/293; 57/294

[58] Field of Search ..... 57/6, 9, 293, 294

[56] References Cited

U.S. PATENT DOCUMENTS

| | | | |
|---|---|---|---|
| 1,961,833 | 6/1934 | Staples | 57/33 X |
| 3,631,662 | 1/1972 | Bienfait | 57/293 X |
| 3,855,777 | 12/1974 | Durkee et al. | 57/293 X |
| 4,002,011 | 1/1977 | Tanaka et al. | 57/293 X |
| 4,196,576 | 4/1980 | Vogelsberg | 57/293 X |
| 4,272,951 | 6/1981 | Vogelsberg | 57/293 |

*Primary Examiner*—Donald Watkins
*Attorney, Agent, or Firm*—Ralf H. Siegemund

[57] ABSTRACT

A stranding machine having a stationary stranding head and a revolving storage and holding capstan is improved by winding one or more ribbons upon the bundle of stranding elements as they are being twisted about each other, preferably in an SZ pattern.

7 Claims, 3 Drawing Figures

STRANDING STOCK OF LARGE CROSS SECTIONS

BACKGROUND OF THE INVENTION

The present invention relates to stranding cable elements of large cross sections, such as conductor elements, each of which being comprised of multiple, stranded filaments, leads, or wires.

In U.S. Pat. No. 4,311,002 (CIP of Ser. No. 944,582), a stranding machine and method has been proposed as follows. A plurality of stationarily mounted but reelable support spools store individual strand elements to be unwound from the spools and combined in a first, non-rotating stranding point. A capstan structure is disposed upstream from that first stranding point and grips the bundle, holds it for a certain travel and storage path, and releases it again, all the while rotating about an axis in the travel path to, thereby, strand or twist the elements about each other and between the stationary stranding point and the point of gripping. Any (additional) twist is not imparted upon the bundle while it is held by and stored in the capstan. A second stranding point is defined and established downstream from the capstan so that the bundle while traveling from the release point of the capstan to the second stranding point receives an additional twist.

The method and equipment as described in said patent is quite advantageous from a point of view of stranding large-diameter stranding elements. It was found, however, that stranding elements of large diameters and being themselves of a stranded construction may exhibit such a degree of flexibility (lack of stiffness) that their position in the stranded bundle as it is being made is not always well defined.

The subject matter added to the continuation application of the above-mentioned patent deals specifically with one aspect of stranding large-diameter elements. The problem solved there related specifically to the stranding zone as between the capstan and the second stranding point and solved a problem arising particularly if the stranding machine is operated to obtain the so-called SZ-stranding pattern.

DESCRIPTION OF THE INVENTION

It is an object of the present invention to improve stranding of elements having relatively large diameters but little stiffness because they are, for example, themselves stranded filaments, wires, or the like.

It is a specific object of the present invention to improve stranding machines which include means (such as spools) for paying individual strand elements toward a stranding head which combines them into a bundle and feeds them toward a storage capstan which grips and holds the bundle as it arrives for a certain storage and travel path length, the capstan revolves relative to the stranding head about the longitudinal travel axis of the bundle in order to obtain stranding of the elements in the bundle, as between the head and the capstan, whereas no additional stranding or twisting is effected while the bundle is being held by the capstan.

In accordance with the preferred embodiment of the invention, it is suggested to wrap one or more, preferably two, ribbons about the bundle, immediately downstream from the stranding head and onto the bundle as it is being stranded and twisted about the longitudinal travel axis; wrapping of the ribbon or ribbons is, of course, also carried out about that axis.

Wrapping a ribbon about a stranded configuration is known per se; the present invention proposes specifically to wrap a ribbon about a bundle as it is being stranded. This way, it is assured that the position of each stranding element in the bundle is determined exclusively by the stranding process; the wrapping holds it against any internal tendency to dislodge. The invention is based, in parts, on the discovery that the stranding, i.e. bundle-twisting, process may proceed underneath the wrapping; but the wrapping stabilizes the relative disposition of the stranding elements to each other as against relative dislodging of one or the other element relative to the others on account of relaxation.

The ribbon used should have a very high tensile strength because it is itself subjected to the stranding process. The ribbons may have a profile which increases friction on the twisted bundle. It was further found to be of advantage to use straightening rollers for the elements, being disposed upstream from the stranding head, and being adjustable thereto in order to optimize the feed angle of these elements relative to the stranding axis.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Figure 1:
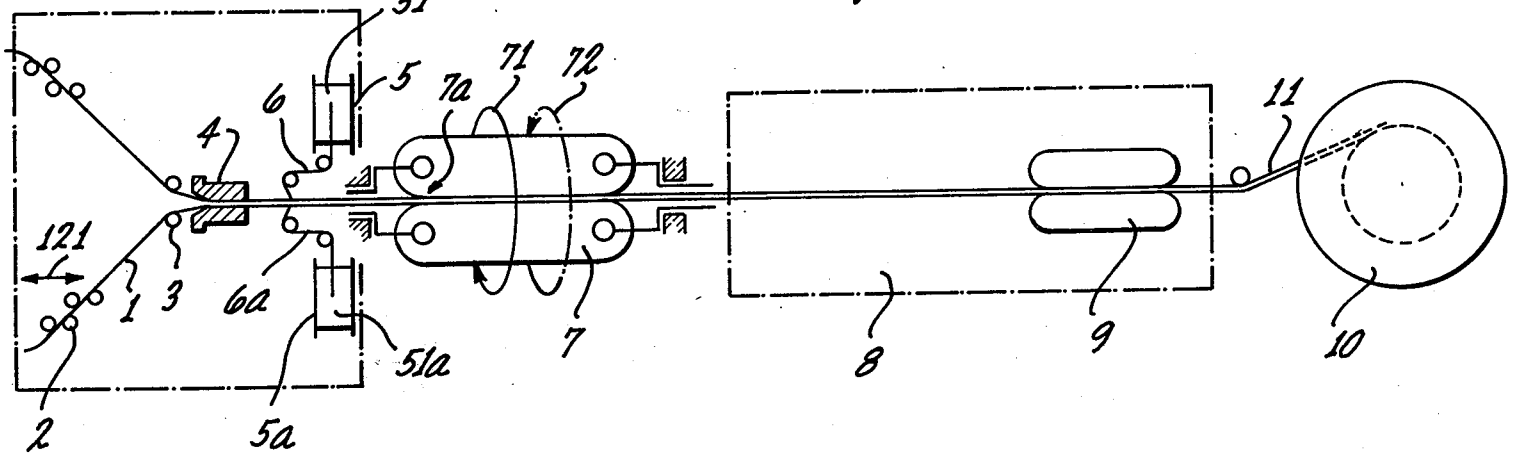
FIG. 1 is a schematic view of equipment for practicing the preferred embodiment of the invention in accordance with the best mode thereof.

FIG. *2a* is a section through a ribbon used in the equipment shown in FIG. 1; and FIG. *2b* is a plan view of a different ribbon.

Proceeding now to the detailed description of FIG. 1, it is assumed that cable elements 1 are to be stranded in order to obtain, e.g., a low-voltage-distributing cable for 1 kilovolt operating voltage and correspondingly high current, requiring, therefore, relatively large cross sections. Accordingly, elements 1 are by and in themselves relatively thick, stranded cable or multi-element section conductors. These elements are stored on spools or drums, not shown, and are withdrawn therefrom for being stranded.

The stranding or twisting machine includes a plurality of roller tracks 2, one per element 1, for purposes of straightening them. Rollers 3 direct the elements toward a stranding head or nipple 4. Contoured filler elements or cores which lodge between the round elements 1 may also be fed to the nipple or head 4.

As indicated by double arrow 121, rollers 2 can be moved in a longitudinal direction to vary the angle of attack vis-à-vis rollers 3. This way, one controls the friction-tension on the elements and the wear and tear on them by operation of the path's deflection as provided by rollers 3. If the rollers 3 were omitted, the adjustment as per arrow 121 would change the feed angle of the stranding elements into the head. The same effect could be obtained by adjusting rollers 3 in direction of arrow 121. Trial and error here permits optimization of the feed angle relative to the stranding operation toward eliminating undue tension in the stranded bundle.

A capstan 7 is provided and may be constructed as shown in the above-identified patent. *7a* denotes the point or area in which the bundle of elements is gripped. The capstan (a) advances the bundle of elements 1 in and along the bundle axis and holds the bundle as a whole; (b) additionally, the capstan revolves about the bundle axis as indicated by the curved arrows 71 and 72. In the case of so-called SZ stranding, the capstan will revolve in alternating directions; as so indicated, stranding does not occur in the bundle since it traverses and is held in and advanced by the capstan itself. Stranding does occur in and along the path between nipple 4 and area or point *7a*. The patent above refers to various configurations for a capstan; these configurations can also be used here.

In accordance with a feature of the preferred embodiment, two ribbons 6 and *6a* are wrapped about the bundle as it leaves head or nipple 4. The points of applying the ribbons are diametrically opposed; i.e., they have the same axial location as the bundle axis, but are 180° out of phase. Thus, two 180°-out-of-phase helices are obtained as wrapping on the bundle. So-called reverse winders 5 and *5a* of a flat construction are used which include spools 51 and *51a* for the ribbons and running them in appropriate directions. In particular, the ribbons, as unreeled, are deflected to run in the reverse direction of advance of the bundle of elements 1; and next, they are reflected toward that bundle, but at a forward angle in order to obtain the helical wrapping. The two winders 5 and *5a* revolve about the longitudinal axis of the bundle and of head 4 so that, indeed, helices result in conjunction with the axial advance of the bundle vis-à-vis the longitudinally propagating bundle. It should be noted that pursuant to SZ-stranding, capstan 7 changes its sense of rotation; but winders 5 and *5a* do not change direction. It makes no difference that, occasionally, the sense of twisting is opposite to the sense of winding.

The term "ribbon" is to be understood in the general sense. The elements 6 and *6a* are to be flat; they may have a profile. These ribbons must be quite strong (of tensile strength) and could be electrically insulative. For example, polytetrafluoroethylene or polyamide, or the like, is well suited. The ribbon may well be woven, or be of mesh-like, or lattice construction, using threads of the afore-mentioned materials.

As indicated by the dashed lines, one may use a case for the straightening rollers 2, the redirecting pulleys 3, and the nipple. Another case, or an integrated case portion, is attached to the first-mentioned case and contains the winding equipments 5 and *5a*. This way, one obtains a rather compact construction.

Figure 2A:
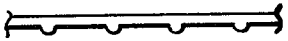
Figure 2B:
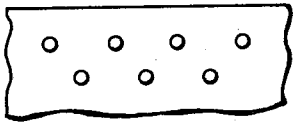

The ribbons themselves could be flat; but profiling in transverse direction is preferred, as illustrated in FIG. 2. This particular ribbon has transverse ribs. Such ribs increase friction of the ribbon as against the stranding elements underneath. Friction should suffice to positively position the stranding elements as stranding; but it should be observed that stranding proceeds underneath the wrapping and should not be impeded by too tight an engagement with the ribbon. If ribs prove to provide too strong a hold, little knobs or bosses, as shown in FIG. *2b*, may suffice as friction enhancement. It should be noted here that the elements and ribbon materials involved may be quite smooth with very little natural friction upon engagement.

Reference numeral 8 refers, generally, to a jacketing equipment which wraps the completed bundle downstream from the capstan. The bundle may, in this manner, obtain a further wrapping as well as an outer jacket. Since the bundle is, additionally, twisted downstream from capstan 7, this additional wrapping and jacket prevents further waviness and dislodgement of the stranding elements.

The reference numeral 9 refers to a stationary caterpillarlike, nonrevolving capstan. The bundle is thus twisted again as between the point of release by capstan 7 and the print of gripping by capstan 9. The completely stranded cable 11 is taken up by and wound upon a drum 10 for storage.

The invention is not limited to the embodiments described above; but all changes and modifications thereof, not constituting departures from the spirit and scope of the invention, are intended to be included.

We claim:

1. In an apparatus for stranding elongated stock paid individually from spools, there being means for pulling the stock and moving the stock in axial direction and including a stationary head, said means for pulling pulling the stock through the head and combining the stock into a bundle; a capstan including means being independently driven, for engaging individually the bundle as moved by the means for pulling, the means upon engaging the bundle holding the bundle while traveling in positive engagement therewith for a particular travel path, said engaging means disengaging from the bundle as the bundle continues beyond said travel path; means for rotating the capstan about an axis along the travel path so that a portion of the bundle, as held by the engaging means, in any instant in positive engagement therewith, is rotated as a whole without being stranded; said capstan being disposed for said engagement with the bundle at a point displaced from said head so that the bundle is stranded as between the head and the capstan, the improvement comprising:

means disposed between said head and the capstan, for winding at least one ribbon about the bundle.

2. In an apparatus for stranding elongated stock, and which includes means for combining a plurality of individually paid strands in a bundle and providing a first, relatively nonrotating stranding point; capstan means, including plural means for engaging the bundle positively and moving with the bundle for a particular travel path before disengaging from the moving bundle; means defining a second nonrotating stranding point, said capstan means being disposed between the first and second stranding point; means for causing the capstan means to rotate in order to obtain stranding of the bundle as between the first stranding point and a point of engagement of the bundle with one of the engaging means, and to obtain additional stranding as between a point of engagement of the bundle with another one of the engaging means, just prior to release of the bundle by the latter engaging means, and the second stranding point, there being no stranding of a portion of the bundle as between the one engaging means and the other engaging means on account of said positive engaging of the bundle, there being means for moving the bundle through the stranding points and the travel path as the bracket means engage the moving bundle, the improvement comprising:

means disposed between the means for combining and the capstan means for winding at least one ribbon about the bundle.

3. Apparatus for stranding elongated stock, comprising:

means for paying individual strands toward a particular area;

means for combining the strands, as paid, in a bundle and for providing a first stranding point through which the bundle passes;

means disposed immediately downstream from the first stranding point, for winding at least one ribbon about said bundle;

means disposed downstream from the means for winding, for positively holding the strands of the bundle as a bundle for a particular travel path as the bundle moves along the travel path together and in engagement with the means for holding, said means for holding, stranding the strands together about an axis, but outside the travel path between the means for positively holding and the first stranding point, while stranding does not occur on and along the particular travel path due to said positive holding;

means defining a second stranding point through which the stranded bundle passes by operation of rotation as between the means for positively holding and the second stranding point; and means for moving the bundle through the first and second stranding points, the means for holding engaging the bundle as so moved through the travel path without stranding a portion of the bundle while on the travel path due to the positive holding.

4. In an apparatus as in claims 1, 2, or 3, the ribbon being profiled.

5. In an apparatus as in claims 1, 2, or 3, the ribbon being of a mesh-like construction.

6. In an apparatus as in claims 1, 2, or 3, the means for winding including at least one spool, means for guiding the ribbon in a direction parallel to but oppositely oriented to said stock downstream from the head, and means for running the ribbon toward the bundle.

7. In an apparatus as in claim 3, including straightening rollers disposed ahead of the means for combining the rollers adjustably in a direction parallel to said travel path.

* * * * *